United States Patent [19]

Brunson

[11] Patent Number: 4,511,008

[45] Date of Patent: Apr. 16, 1985

[54] ROTARY CUTTER DRILL BIT WITH PERMANENT SNAP RING CUTTER RETENTION

[75] Inventor: David T. Brunson, Arlington, Tex.

[73] Assignee: Dresser Industries, Inc., Dallas, Tex.

[21] Appl. No.: 568,979

[22] Filed: Jan. 6, 1984

[51] Int. Cl.[3] ..... E21B 10/08

[52] U.S. Cl. ..... 175/369; 384/96

[58] Field of Search ..... 175/369, 368, 371; 188/67; 24/628, 239; 384/96

[56] References Cited

U.S. PATENT DOCUMENTS

| | | | |
|---|---|---|---|
| 1,847,981 | 3/1932 | Reed | 175/369 |
| 4,157,122 | 6/1979 | Morris | 175/369 |
| 4,444,518 | 4/1984 | Schramm et al. | 175/369 X |

*Primary Examiner*—Stephen J. Novosad
*Assistant Examiner*—Michael Starinsky
*Attorney, Agent, or Firm*—Fred A. Winans

[57] ABSTRACT

Structure for permanently retaining a rolling cutter on a journal pin of a rotary cutter earth boring bit is shown. The structure is defined by opposed, axially aligned, circumferential grooves formed in the mating bearing surfaces of the pin and the assembled cutter. The cutter groove is a single width throughout whereas the pin groove defines a double width for an arcuate extent thereof on its unloaded side. A split snap ring is compressed within the pin groove, with the ends of the ring axially overlapping in the double width portion so that the ring does not extend above the surface of the pin. Upon alignment of the grooves, during assembly of the cutter on the pin, the ring snaps into the cutter groove with the ends in abutting relationship and extends radially into the pin groove to retain the cutter on the pin. The single width groove in the cutter prevents the ring ends from ever again assuming an axially overlapped cutter-release condition thereby providing permanent retention of the cutter on the pin.

8 Claims, 5 Drawing Figures

ROTARY CUTTER DRILL BIT WITH PERMANENT SNAP RING CUTTER RETENTION

BACKGROUND OF THE INVENTION

1. Field of the Invention

The invention relates generally to a rotary cutter earth boring bit, and more specifically to structure for retaining the rotary cutter on the journal bearing pin.

2. Description of the Prior Art

Throughout the development of the rotary cutter earth boring rock bit, many methods have been developed for retaining the cutter on the journal bearing pin. For the most part, the present commercially acceptable method of cutter retention requires the use of balls disposed in opposed axially aligned circumferential grooves formed within the bearing surface of the pin and the mating bearing cavity of the cutter. This requires a ball passage, formed within the pin, extending from exteriorly of the pin to the circumferential groove, for loading the balls within the groove subsequent to the cutter being assembled thereon. In addition to the balls occupying substantial axial space that might otherwise be used for greater journal bearing surface and capacity, during normal drilling operations the forces of the cutter force the cutter inward toward the center of the hole (in-thrust) and the balls are directly subjected to loading which can cause spalling or partial failure of the ball grooves which forms metal debris within the bearing cavity. This debris in turn can cause premature failure of the journal bearings. Also the balls and grooves can become worn to the extent that complete failure of the retention mechanism occurs whereby the cutter can be lost in the hole. In either instance, the results are rather catastrophic.

Further, the use of balls as retaining means presents problems associated with the ball passage. In this regard a hole must be formed through the bit arm to the ball groove in order to install the balls. This hole or passage is subsequently filled with a hand-fitted ball plug which must be welded in place. This hand-fitting requires a great amount of care, as does the welding process, adding to the manufacturing and assembly processes and allowing a greater possibility of faulty assembly which again leads to rather catastrophic results.

Although the prior art is replete with snap ring structure for retaining the cutter on the journal pin, heretofore none of this proposed structure has found commercial acceptability, generally for the reasons that it either adds rather complex structure to the assembly or permits the snap ring to be deformed or compressed during actual drilling operations, to a position where it no longer retains the cutter on the pin, thereby permitting the cutter to be released, neither of which are acceptable in this highly competitive field.

Reference is made to U.S. Pat. No. 3,746,405 which, for the most part, is directed to a lubrication and seal structure for a rotary cutter rock bit, but also discloses, with reference to FIG. 2, a cutter retention structure utilizing the balls disposed in opposed grooves as above discussed. However, with reference to FIGS. 5 and 6 thereof, a snap ring retainer is shown disposed within opposed grooves in the pin and cutter bearing surfaces. As therein seen, the ends of the snap ring, in its relaxed condition, are arcuately separated so that the ring can be deformed or compressed to a non-interfering position for assembly of the cutter over the pin. Once the cutter is assembled in the proper position and the opposed grooves aligned, the snap ring snaps outwardly to a cutter retention position. However, in such condition, the frictional forces during operation of the bit can cause the ring to again deform to a non-interfering position whereby the cutter will be released from the pin under any in-thrust loading.

U.S. Pat. No. 4,236,764 also discloses a snap ring received within opposed aligned grooves between the journal and the bearing surface of the cutter, with the pin groove having a geometry such that, as the cutter experiences in-thrust forces the retaining ring is, by virtue of the angled faces, forced to expand radially outwardly to an interfering condition that prevents the cutter from being released. However, again it is shown that the ends of the snap ring are separated by an arcuate space so that, once the ring is expanded to its relaxed condition within the opposed grooves to prevent release of the cutter, it is possible for the ring to be deformed to a non-interfering position by closure of this arcuate gap whereupon the cutter would be released. It has been found that if such action is at all possible, during drilling operations wherein various forces are encountered, there are circumstances where it will occasionally occur with loss of the cutter downhole.

Other prior art patents show snap rings or expandable rings received between opposed grooves on the journal and the cutter and which are prevented from collapse by other structure such as a threaded attachment subsequently assembled, or its equivalent, (see U.S. Pat. Nos. 2,654,577 and 2,579,819). However, such structure provides a generally weakened bearing assembly in addition to adding parts and labor to the overall structure. Other prior art devices include a lock nut such as shown in U.S. Pat. No. 3,971,600 and a welded thrust member which is welded onto the journal pin subsequent to the cone being assembled thereon such as shown in 4,176,724. In both these instances, the subsequent assembly techniques are difficult and time-consuming and the resultant structure susceptible to stress-induced premature failure.

SUMMARY OF THE INVENTION

The present invention provides a rotary cutter earth boring bit having a cutter rotatably mounted on a journal pin generally having conventional structure except for the cutter retention structure of the present invention. According to the present invention, a circumferential groove is provided in the journal pin in axial alignment with a circumferential groove in the opposed surface of the cutter when the cutter is fully assembled on the pin. The cutter groove is a single axial width throughout its circumference whereas the pin groove is a single width, or a little larger, for a portion thereof but has a double axial width extending toward the root of the pin over the remainder. To maximize the bearing surface of the loaded side, the double axial width portion is on the unloaded side of the pin.

A split snap ring, having a like single axial width and, in its relaxed position having an o.d. slightly larger than the o.d. of the cutter groove, and a radial depth greater than the radial depth of the cutter groove, is compressed or deformed to a position completely within the pin groove by axially overlapping the split ends of the ring in the double width portion of the pin groove, permitting the cutter to be assembled thereover. Upon axial alignment of the pin and cutter grooves, the ring snaps into the single width cutter groove, with the ends of the split ring in generally abutting engagement, and extends into the pin groove to retain the cutter thereon. As the ring is then disposed within a single width groove the ends cannot be axially overlapped. Also the radial dimension of the ring is such that the opposed ends cannot be radially overlapped in the pin groove. The snap ring is thus positively prevented from being compressed or deformed to a releasing condition, thereby permanently retaining the cutter on the journal pin.

DESCRIPTION OF THE PREFERRED EMBODIMENT

Figure 1:
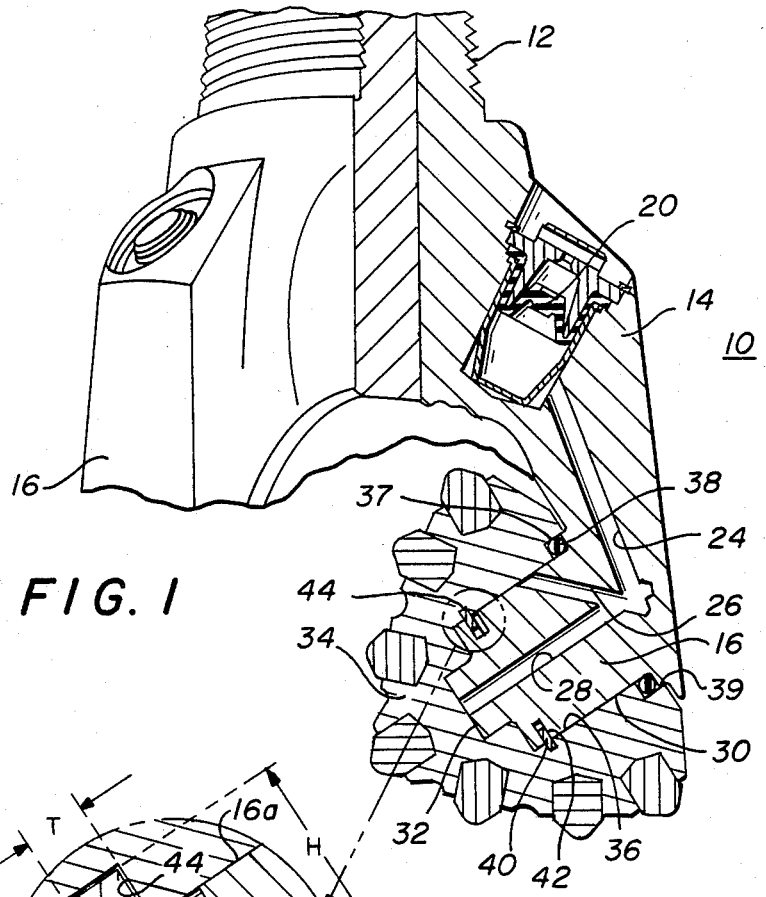
FIG. 1 is an elevational view of a portion of a rock bit with one leg thereof in cross-section to show the cutter retained on the journal pin according to the present invention.

Referring to FIG. 1, one leg and integral journal pin and cutter assembly of a tri-cone rotary rock bit is shown, it being understood that the complete bit includes two more such rotary cutters similarly assembled on their respective journal pins. As therein shown, the rock bit 10 includes an upper threaded portion 12 for securing it to the end of a rotary drill pipe. The bit body also includes leg 14, (a portion of another leg also being shown) extending downwardly from the main body portion and terminating in an inwardly directed bearing pin 16. As is also well known in the art, each leg contains a sealed lubricant reservoir 18 having a pressure-responsive diaphragm 20 for forcing lubricant from the reservoir 18, through leg-passage 24 and distributing passages 26, 28 in the bearing pin for directing pressurized lubricant to the journal bearing surface 30 and thrust bearing surface 32 of the bearing pin 16.

A rotary cutter 34 is rotatably mounted on the journal pin 16 and defines an internal cavity or bore 36 in substantially opposed mating bearing engagement with the journal bearing surface 30 and thrust bearing surface 32. A seal element 38, such as an O-ring seal, is disposed in a gland 37 at the mouth 39 of the cone cavity 36 to seal the lubricated bearing surfaces 36, 30, 32 from the external ambient conditions. In accordance with the present invention, and as more fully explained hereinafter, a snap ring 40 is disposed in axially aligned grooves 42 and 44 in the pin 16 and cutter bearing surface 36, respectively.

During operation, the weight of the drill string is transmitted through the cutter to the borehole bottom by the lower or loaded surface of the journal bearing pin 16 engaging and bearing against the opposed surface 36 of the cutter, thereby defining the upper bearing surface of the pin **16*a*** as an unloaded surface.

Figure 2:
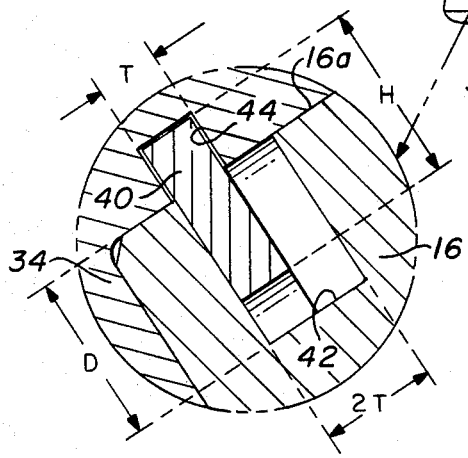
FIG. 2 is an enlarged portion of FIG. 1 showing the snap ring of the present invention on the unloaded surface of the journal pin.

Reference is now made to FIG. 2 which shows the mating grooves 42, 44 and snap ring 40 as disposed in the unloaded journal bearing surface **16*a*. As therein seen the cross-sectional configuration of the grooves and snap ring is essentially rectangular with the axial thickness T of the circumferential groove 44 in the cutter 34 generally equal to the axial thickness of the snap ring 40 whereas the axial thickness of the groove 42, at least in a portion of bearing pin 16 (for greater detail see FIG. 5) substantially twice (2 T) the axial thickness of the snap ring 40 therein to accommodate an axial overlapping of the ring ends 40*a*, 40*b* therein. Also it is seen that the radial depth D of the groove 42 in the journal pin 16 is generally equal to or greater than the radial height H of the snap ring 40 so that the snap ring 40 can be completely received within the groove 42 without projecting radially thereabove. Further, the circumference of the groove 44 in the cutter is slightly less than the circumference (or projected circumference) of the snap ring 40 in its relaxed position for residually maintaining a tight or non-sloppy fit in the groove, in which position the snap ring 40 extends radially across the opposed engaging journal bearing surfaces 30, 16**.

Figure 3:
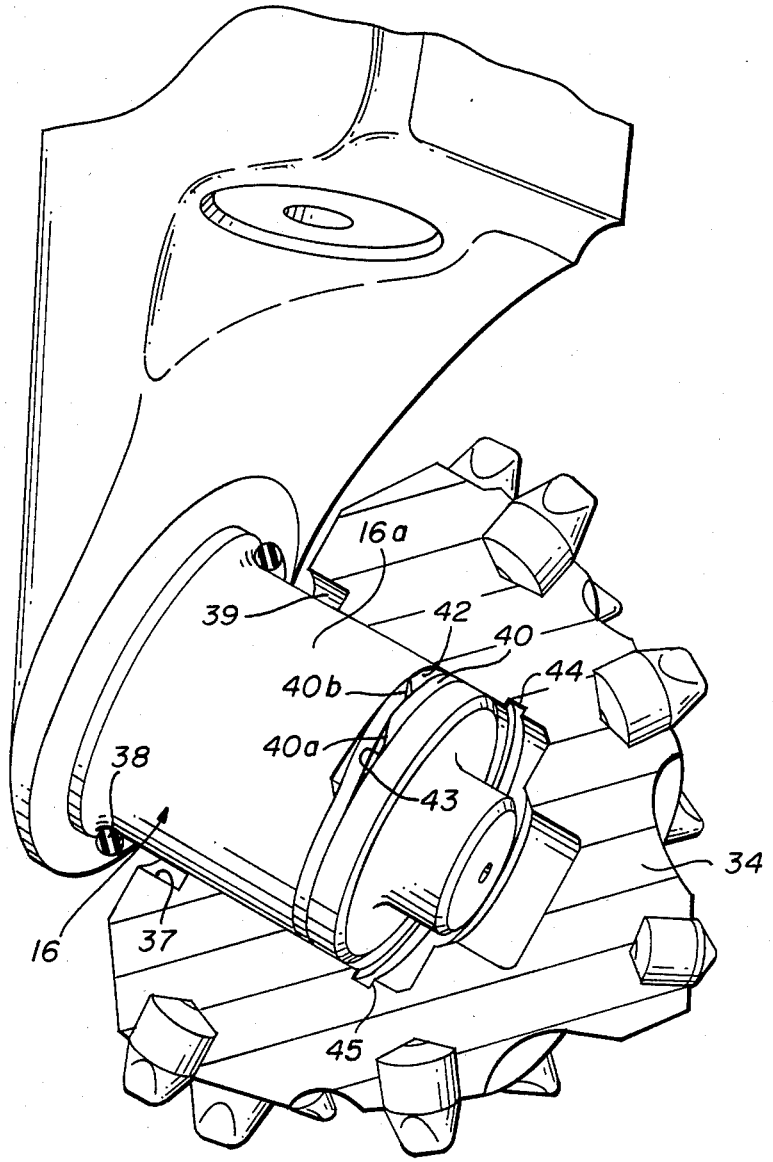
FIG. 3 is an isometric view of the journal pin and cross-sectioned rolling cutter in partial assembly.
Figure 5:
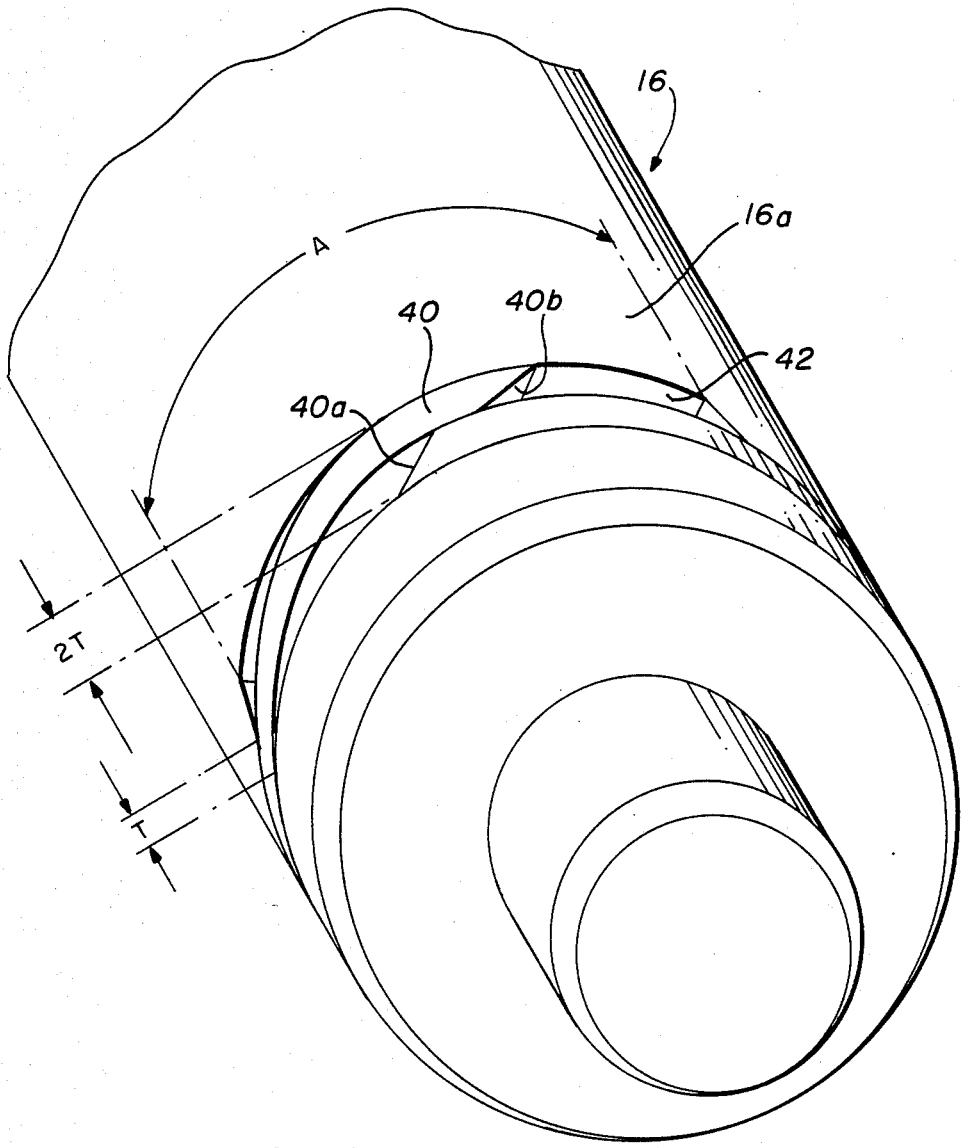

Referring now to FIG. 3 in conjunction with FIG. 5, the disposition of the snap ring 40 within the groove 42 of the pin 16 is shown during assembly and prior to complete assembly. As therein seen, the snap ring 40 is split to form two opposed ends **40*a* and 40*b* and is deformed or compressed from its normal relaxed position so as to be completely received within groove 42 by the ends 40*a* and 40*b* being axially overlapping. This axial overlapping of the ends 40*a* and 40*b* is permitted by the double axial thickness of the groove 42 which extends through an arcuate portion identifying an angle A on the unloaded surface 16*a* of pin 16 with the loaded surface having a single width groove to maximize the bearing area. (In the preferred embodiment, angle A is about 150° to minimize abrupt bends in the ring 40.) This permits the cutter 34 to be slidingly mounted on the journal pin 16 with the internal bearing surface 36 of the cutter retaining the snap ring 40 in this deformed position until the outer wall 45 of the groove 44 in the cutter 34 is axially aligned with the outer wall 43 of the groove 42 in the pin 16 whereupon the ring can snap into groove 44**.

Figure 4:
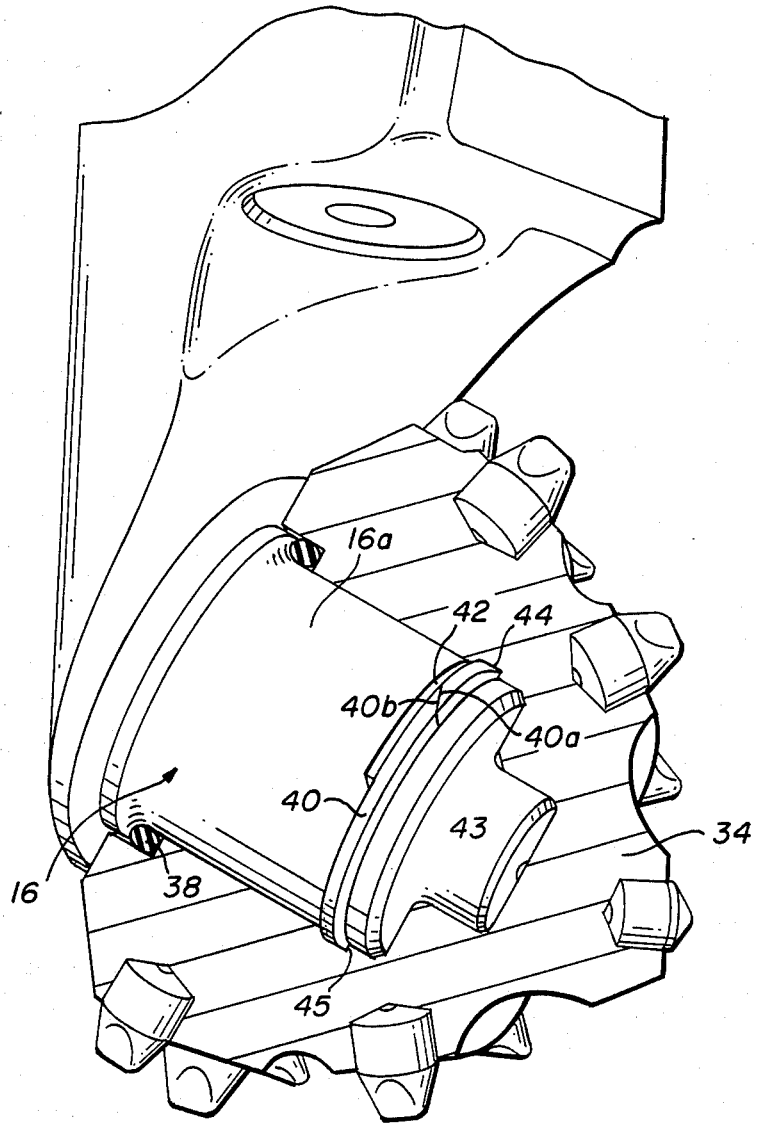
FIG. 4 is a view similar to FIG. 3 showing the cutter and pin in full assembly; and, FIG. 5 is a schematic isometric of the journal pin and snap ring in position prior to assembly of the rolling cutter thereon.

Referring now to FIG. 4, the position of the snap ring 40 is shown once the outer walls 43 and 45 of the opposed grooves 42, 44 respectively become axially aligned. It will be appreciated that when groove 44 becomes axially aligned with groove 42, the inherent resiliency of the snap ring 40 will force the snap ring 40 outwardly into groove 44, allowing the circumference of the snap ring 40 to expand to its normal position, whereby the ends **40*a* and 40*b*** do not and cannot axially overlap.

Once the snap ring 40 has expanded outwardly to the circumference of groove 44, it is retained in the groove 44 by virtue of this groove being of a single thickness T throughout its circumference (or at least less than the axial thickness of the overlapped ends of the snap rings) and will not permit the snap ring 40 to become compressed or deformed into an axially overlapped condition. Further, it will be noted that due to the relationship between the radial height of the snap ring 40 and the radial depth of the groove 42, the snap ring is also prevented from overlapping in a radial manner. In the finally assembled condition, the two opposed ends **40*a* and 40*b* either abut or are in close enough adjacent relationship such that compression of the ring to close any spatial separation that exists therebetween would not be sufficient to permit the circumference of the snap ring to be reduced to the circumference of the journal 16 to release the cutter 34**.

In the preferred embodiment of the present invention, as shown in FIGS. 3 and 5, the ends 40*a* and 40*b* of the snap ring 40 are in substantially abutting relationship when the ring 40 is disposed within the cutter groove 44; however, it is to be understood that an arcuate spatial separation of the two ends would also be permitted as long as closure of this separation, as by frictional forces during drilling causing the two such separated ends to abut, does not reduce the outer diameter of the ring 40 to less than the outer diameter of the journal pin 16.

It should also be pointed out that, except for the result of reducing the bearing surface, the double width portion of groove 42 could extend completely around pin 16, except for a small portion necessary to prevent the ring 40 from on assembly, being forced to the back of the double thickness so that it would never attain alignment with the single width groove 44 in the cone 34. However, with one area or point of single width abutment in groove 42 providing at least some arcuate extent of axial alignmnet between single width portions of opposed grooves 42, 44, the ring 40 will snap into a complete seating engagement in the single width groove 44. It is anticipated, if such small single width groove area were provided, it would not be effective as a bearing area and therefore would be preferably disposed on the unloaded surface. Such a bearing surface on the pin would still have more effective bearing area than is permitted with a core retention structure employing balls as previously discussed.

Further, the single width portion of groove 42 in the journal 16 is preferably made larger than groove 44 in the cone to prevent the normal out-thrust loading on ring 40, so that ring 40 only intermittently is subjected to thrust loading, i.e. in-thrust loading towards the center of the hole, which is the force tending to force the cone off the journal.

It will also be appreciated that the ends 40*a*, 40*b*, of snap ring 40 are tapered in a manner that causes them to cam past one another in an axial overlapping position when compressive forces are placed on the ring 40, and thus facilitate assembly of the ring in the following manner.

Snap ring 40 is initially deposited over a tapered spindle having a taper from the relaxed i.d. of the ring 40 to the o.d. of the journal 16. The spindle has a cavity for receipt of the nose of the journal, so the spindle and journal can be placed in continuous abutting engagement. Thus, the expanded ring 40 can be axially forced from the spindle onto the journal 16 and thence into groove 40.

The snap ring 40 is then engaged in a ring compression fixture, i.e. on the nature of a piston ring compression device, which circumferentially squeezes ring 40 so that the ring o.d. is less than the i.d. of the cone cavity 36.

The cone is then axially pressed onto journal 16, axially displacing the ring compression fixture so that the cone cavity 36 then retains the ring 40 compressed until grooves 42, 44 are in axial alignment as previously described, whereupon the ring 40 snaps into the cutter groove 44 and is permanently retained therein and permanently prevents removal of the cone from the journal.

We claim:

1. In an earth boring apparatus including an earth engaging cutter rotatably mounted on a journal, said cutter having an internal annular surface in opposed axial alignment with an annular surface of said journal, an improved cutter retention means disposed therebetween and cooperating with said opposed annular surfaces to retain said cutter on said journal, and wherein said improved cutter retention means comprises:

a first groove in said internal annular surface of said cutter, said first groove having a first axial width;

a second groove in said annular surface of said journal, said second groove having one portion defining a like first axial width in axial alignment with said first groove and the remainder thereof having an enlarged axial width;

a resilient split ring of generally said first axial width and having a circumference when the ends of said ring abut, greater than the circumference of said annular surface of said journal, and wherein the radial depth of said ring is greater than the radial dimension of said first groove and not greater than the radial dimension of said second groove;

whereby during assembly of said cutter on said journal, said ring is disposed within said second groove and compressed to be generally coextensive with the surface of said journal by the ends of said ring being axially overlapped in said axially enlarged remainder of said second groove, whereupon said ring, upon axial alignment of said first groove with said one portion of said second groove, snaps into said first groove radially extending between the opposed first and second grooves and prevented from again assuming a compressed condition coextensive with said journal so that the cutter is permanently retained on said journal.

2. Structure according to claim 1 wherein said split ring, as received within said first groove, forms a substantially continuous outer circumference generally equal to the circumference of said first groove whereby said ring ends are in generally abutting relationship.

3. Structure according to claim 1 wherein said split ring ends are tapered from the axial width of the ring to terminate in an end of substantially less axial width whereby circumferential compression of said ring causes the ends to cam past one another in an axially overlapping condition.

4. Structure according to claim 3 wherein said split ring and said grooves generally define rectangular cross-sections.

5. Structure according to claim 1 wherein said one portion of said second annular groove has an arcuate extent over generally the loaded side of said journal.

6. Structure according to claim 1 wherein said first annular groove and said one portion of said second annular groove are in axial alignment when said cutter is mounted on said journal and wherein said remainder of said second groove is axially enlarged in a direction therefrom corresponding to the axial direction of cutter movement on assembly of said cutter on said journal.

7. Structure according to claim 1 wherein the axial width of said first annular groove is at least slightly larger than the axial width of said ring but less than the total axial width of the opposed ends of the ring in axially overlapping position.

8. Structure according to claim 1 wherein any spatial seperation of the ends of said split ring, as assembled within said first groove, is insufficient to permit the outer diameter of the ring to become less than the outer diameter of said journal upon abutment of the ends.

* * * * *